US010231482B2

(12) United States Patent
Tritz et al.

(10) Patent No.: US 10,231,482 B2
(45) Date of Patent: Mar. 19, 2019

(54) SMOKING ARTICLE WITH REDUCED MOUTH END STAINING

(71) Applicant: PHILIP MORRIS PRODUCTS S.A., Neuchatel (CH)

(72) Inventors: Dorothy Tritz, Yverdon-les-Bains (CH); Charles Kuersteiner, Jouxtens-Mezery (CH); Leonardo Nappi, Hauterive (CH); Alen Kadiric, Biel (CH)

(73) Assignee: Philip Morris Products S.A., Neuchâtel (CH)

( * ) Notice: Subject to any disclaimer, the term of this patent is extended or adjusted under 35 U.S.C. 154(b) by 0 days.

(21) Appl. No.: 14/431,192

(22) PCT Filed: Sep. 18, 2013

(86) PCT No.: PCT/IB2013/058646
§ 371 (c)(1),
(2) Date: Mar. 25, 2015

(87) PCT Pub. No.: WO2014/049494
PCT Pub. Date: Apr. 3, 2014

(65) Prior Publication Data

US 2015/0257439 A1 Sep. 17, 2015

Related U.S. Application Data

(60) Provisional application No. 61/706,933, filed on Sep. 28, 2012.

(30) Foreign Application Priority Data

Sep. 28, 2012 (EP) ..... 12186683

(51) Int. Cl.
*A24D 1/02* (2006.01)
*A24D 3/04* (2006.01)

(52) U.S. Cl.
CPC *A24D 3/04* (2013.01); *A24D 1/02* (2013.01)

(58) Field of Classification Search
None
See application file for complete search history.

(56) References Cited

U.S. PATENT DOCUMENTS 3,336,928 A 8/1967 Morehouse
3,752,165 A 8/1973 Harllee et al.
(Continued)

FOREIGN PATENT DOCUMENTS

GB 2 105 566 A 3/1983
GB 2 118 819 A 11/1983
(Continued)

OTHER PUBLICATIONS

International Preliminary Report on Patentability from PCT/IB2013/058646, dated Apr. 9, 2015, from the International Bureau of WIPO; 6 pgs.

(Continued)

*Primary Examiner* — Phu H Nguyen
(74) *Attorney, Agent, or Firm* — Mueting, Raasch & Gebhardt, P.A.

(57) ABSTRACT

Smoking articles have a mouth end portion that includes a central filter plug having an outer surface. The mouth end portion further includes a peripheral region disposed about the outer surface of the central filter plug. The peripheral region may include one or more channels through which smoke may flow. The smoking article includes an exterior wrap that is disposed about the peripheral region of the mouth end filter portion. The permeability of smoke through the peripheral region is five times or more greater than the permeability of smoke through the central filter plug. By increasing the permeability of smoke around the central filter plug, less smoke travels through the central filter plug (Continued)

in the mouth end portion and less staining of the mouth end of the central filter plug results.

21 Claims, 3 Drawing Sheets

(56) References Cited

U.S. PATENT DOCUMENTS

| | | | | |
|---|---|---|---|---|
| 3,841,338 | A | 10/1974 | Horsewell et al. | |
| 4,007,746 | A * | 2/1977 | Sawada | D06M 13/224 106/170.31 |
| 4,135,532 | A | 1/1979 | Luke et al. | |
| 4,256,122 | A * | 3/1981 | Johnson | A24D 3/043 131/336 |
| 4,582,071 | A | 4/1986 | Westcott et al. | |
| 4,774,972 | A | 10/1988 | Hayes | |
| 4,904,308 | A * | 2/1990 | Charlton | A24D 3/041 131/198.1 |
| 2008/0060746 | A1 | 3/2008 | Van de Camp | |

FOREIGN PATENT DOCUMENTS

| | | | |
|---|---|---|---|
| GB | 2118424 | A | 11/1983 |
| JP | S50-160596 | | 12/1975 |
| JP | S61-249378 | A | 11/1986 |
| WO | WO 2012/042199 | A1 | 4/2012 |

OTHER PUBLICATIONS

International Search Report and Written Opinion from PCT/IB2013/058646, dated Feb. 13, 2014, from the European Patent Office as the International Search Authority; 9 pgs.

Notice of Allowance issued in the corresponding Ukraine Patent Application No. a 2015 02519, dated Dec. 23, 2017 (8 pgs.).

* cited by examiner

SMOKING ARTICLE WITH REDUCED MOUTH END STAINING

This application is the § 371 U.S. National Stage of International Application No. PCT/IB2013/058646, filed 18 Sep. 2013, which claims the benefit of U.S. Provisional Application No. 61/706,933, filed 28 Sep. 2012 and European Application No. 12186683.4, filed 28 Sep. 2012, each of which are incorporated by reference herein in their entireties.

This disclosure relates to smoking articles having a novel and inventive mouth end portion that prevents or reduces staining of the mouth end of the smoking article.

Combustible smoking articles, such as cigarettes, typically have shredded tobacco surrounded by a paper wrapper forming a tobacco rod. A cigarette is employed by a smoker by lighting one end of the cigarette and burning the shredded tobacco rod. The smoker then receives mainstream smoke into their mouth by drawing on the opposite end or mouth end of the cigarette, which typically contains a filter. The shredded tobacco can be a single type of tobacco or a blend of two or more types of tobacco depending of the brand of cigarette.

A number of smoking articles in which an aerosol generating substrate, such as tobacco, is heated rather than combusted have also been proposed in the art. In heated smoking articles, the aerosol is generated by heating the aerosol generating substrate. Known heated smoking articles include, for example, smoking articles in which an aerosol is generated by electrical heating or by the transfer of heat from a combustible fuel element or heat source to an aerosol generating substrate. During smoking, volatile compounds are released from the aerosol generating substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

The filters in smoking articles tend to stain during use. Such staining is typically visible at the mouth end of the article. Some smokers would prefer a smoking article in which staining is not significant or visible after smoking.

It would be desirable to provide a smoking article that tends to result in less staining at the mouth end filter portion than currently available smoking articles.

In one aspect of the present invention, smoking articles have a mouth end filter portion that includes a central filter plug having an outer surface. The mouth end filter portion further includes a peripheral region disposed about the outer surface of the central filter plug. The smoking article includes an exterior wrap that is disposed about the peripheral region of the mouth end filter portion. The permeability of smoke through the peripheral region is five times or more greater than the permeability of smoke through the central filter plug. By increasing the permeability of smoke around the central filter plug, less smoke travels through the central filter plug in the mouth end portion. As a result, less staining of the mouth end central filter plug may occur relative to a smoking article not having the more permeable peripheral region in the mouth end segment. Preferably, no visible staining of the mouth end central filter plug is observable after the smoking article is smoked.

The increased permeability of the peripheral region relative to the central filter plug may be realized by channels in the peripheral region that extend the length of the mouth end portion and open to the mouth end. Any suitable channel formation or construction may be employed. For example, the channels may be disposed about the central filter plug in a spirally wound manner or may extend along the longitudinal axis of the smoking article. When wrapped, the channels form conduits through with smoke may readily flow. The resistance to draw of the peripheral region containing the channels is substantially less than the resistance to draw through the central filter plug. Accordingly the permeability of the smoke through the peripheral region is substantially greater than the permeability of smoke through the central plug of the mouth end portion.

Generally, the mouth end filter portion of the smoking article has an outer dimension similar to currently available smoking articles. For example, the mouth end portion may have a diameter of from about 4 mm to about 9 mm. Of course, the mouth end filter portion may have any suitable outer diameter.

The mouth end filter portion may be of any suitable length. In embodiments, the mouth end filter portion has a length of about 5 mm or greater, such as about 6 mm of greater, about 7 mm or greater, or about 8 mm or greater. Alternatively or in addition, the length of the mouth end portion may be about 40 mm or less or about 30 mm or less. In some cases, the mouth end filter portion is preferably between about 5 mm and about 40 mm, more preferably between about 5 mm and about 30 mm.

The mouth end filter portion may be adjacent to or abut an upstream filter portion or portions. As used herein, "upstream" is defined relative to air flow during use of the smoking article, with the mouth end of the article being the "downstream" end through which air and smoke is drawn by the user, and the end opposite the mouth end is the "upstream" end. The cumulative length of the mouth end region and the upstream filter portion is preferably about the same as the lengths of filter portions of currently available smoking articles. For example, the cumulative length of the mouth end region and the upstream filter portion is preferably from about 10 mm to about 40 mm, more preferably from about 12 mm to about 30 mm. Preferably, the outer diameter of the smoking article is substantially the same along the mouth end filter portion as it is along the upstream filter portion or portions. The upstream filter portion or portions may be formed from any suitable filter material typically employed in smoking articles, such as cellulose acetate tow.

In embodiments, it may be desirable to extend the length of the upstream filter portion beyond a typical length of a filter by an amount approximately equal to the length of the mouth end filter portion. This is because the mouth end portion will not be expected to contribute significantly to filtering because most or all of the smoke in this portion will flow through the channels rather than the central filter plug. By extending the length of the upstream filter portion by an amount approximately equal to the length of the mouth end filter portion, the overall filtering efficiency of the smoking article may be maintained. Alternatively, or in addition, it may be desirable to increase the filtering efficiency of the upstream filter portion. By increasing the efficiency, the cumulative length of the mouth end portion and the upstream filter portion may be maintained at lengths of filter portions of smoking articles currently available.

The central filter plug of the mouth end filter portion may be formed of any suitable material. To provide the look of currently available smoking articles, the central filter plug may be formed from cellulose acetate or a material that comprises cellulose acetate. In embodiments, the central filter plug comprises, or consists of, cellulose acetate tow. To reduce the permeability to smoke, the cellulose acetate tow of the central filter plug may include a plasticizer, which when formed with hot steam may harden the cellulose acetate tow to increase resistance to draw or decrease permeability. In embodiments, the cellulose acetate tow of the central filter plug includes about 10 weight percent or greater plasticizer, such as about 15 weight percent or greater plasticizer. The central filter plug or an upstream filter portion, if present, may optionally include adsorbents or additives as are generally known in the art. The central filter plug or an upstream filter portion, if present, may optionally include a capsule or thread as generally known in the art.

In embodiments, the mouth end filter portion includes a peripheral region having one or more channels disposed about the central filter portion. Material forming the channels may be in contact with material forming the central filter plug. In embodiments, a layer may be disposed between the material forming the channels and the material forming the central filter plug. The layer is preferably formed from material that would inhibit or prevent diffusion of smoke in the channels to the central filter plug, which should assist in preventing staining of the central filter plug. The intermediate layer may be formed of any suitable material, such as paper, cellulose film, or the like.

The permeability of the channels to smoke is preferably sufficiently greater than the permeability of the central plug to prevent substantial staining of the central filter plug. Regardless of whether a layer is present between one or more channels and the central filter plug of the mouth end segment of the smoking article, the resistance to draw is preferably substantially lower through the peripheral region having the channels than through the central filter plug. The lower resistance to draw will result in more smoke flowing through the channels than through the central filter plug, which results in reduced staining of the central filter plug relative to mouth end staining of filter plugs that do not have peripheral channels. The resistance to draw of the peripheral region containing the channels is preferably close to zero mm water gauge ("mm WG"). In embodiments, the resistance to draw of the peripheral region containing the channels is about 10 mm WG or less, such as about 5 mm WG or less or about 1 mm WG or less. The resistance to draw of the peripheral region of a mouth end portion described herein can be directly measured by blocking the mouth end of the central filter plug and measuring the resistance to draw of the peripheral region. The mouth end of the central filter plug may be blocked with an adhesive plug, film cut to the shape of the mouth end of the central filter plug, or the like. However, if the resistance to draw of the peripheral region is substantially lower than the resistance to draw of the central filter plug, the resistance to draw of the entire mouth end filter portion (without blocking the mouth end of the central filter portion) will approximately be equal to the resistance to draw of the peripheral region.

The resistance to draw of the central filter portion may be tested by blocking the peripheral region at the mouth end of the mouth end filter portion. The mouth end of the peripheral region may be blocked with an adhesive plug, film cut to the shape of the mouth end of the peripheral region, or the like. Alternatively, the resistance to draw of the central filter portion may be tested on the central plug portion that is not yet incorporated into, or has been removed from, a mouth end segment. In embodiments, the resistance to draw of the central filter plug is about 50 mm WG or more, such as about 100 mm WG or more or about 200 mm WG or more. Typically, the resistance to draw of the central filter plug is less than about 500 mm WG. Resistance to draw may also be expressed in terms relative to length. For example, a central filter plug may have a resistance to draw of equal to or greater than about 5 mm WG/millimeter of length of the central plug portion, such as equal to or greater than about 10 mm WG/mm or equal to or greater than about 20 mm WG/mm. Typically, resistance to draw of the central filter plug is less than about 100 mm WG/millimeter of length of the central filter plug.

In embodiments, the resistance to draw of the central plug is five times or more greater than the resistance to draw through the peripheral region having the channels, such as 10 times or more greater or 50 times or more greater.

It will be understood that resistance to draw is proportional to permeability of smoke. Accordingly, if the peripheral region of the mouth end segment has a resistance to draw that is about 10 times less than the resistance to draw of the central filter plug; the peripheral region will have a permeability to smoke of about 10 times more than the permeability to smoke of the central filter plug. In embodiments, the permeability of smoke through the peripheral region of the mouth end portion is about 5 time or more greater than the permeability of smoke through the central filter plug of the mouth end portion, such as about 10 times or more greater or about 50 times or more greater.

Accordingly, the amount of smoke that flows through the peripheral region will be substantially greater than the amount of smoke that flows through the central filter plug, which should result in significantly less staining of the central filter plug. Preferably, substantially all of the smoke that flows through the mouth end portion of the smoking article flows through the peripheral region. In embodiments, about 80% or more of the smoke that flows through the mouth end portion of the smoking article flows through the peripheral region, such as about 90% or more or about 95% or more. Accordingly, about 20% or less, such as about 10% or less or about 5% or less, of the smoke that flows through the mouth end portion of the smoking article flows through the central filter plug.

Regardless of the relative amounts of smoke that flows through the central filter portion and the peripheral region, mouth end staining of the central filter plug is preferably substantially reduced in smoking articles having mouth end portions with peripheral regions having channels relative to similar smoking articles that do not have mouth end portions with peripheral regions having channels. Preferably little or no visible staining of the central filter plug occurs following smoking of a smoking article having a mouth end portion with one or more channels as described herein. In embodiments, mouth end staining of the central filter plug is reduced by about 50% or more relative to similar smoking articles that do not have mouth end portions with peripheral regions having channels, such as about 75% or more, about 80% or more, about 85% or more, about 90% or more, or about 95% or more. Relative staining reduction may be compared using analytical instrumentation or by visual approximation.

The one or more channels in the peripheral region that are disposed about the central filter plug, with or without and intermediate layer, may be formed in any suitable manner. In embodiments, the channels are spirally wrapped about the central filter plug. By way of example, the process described in U.S. Published Patent Application 2008/060746, entitled Spirally Wound Tube with Voids and Methods for Manufacturing the Same, naming van de Camp as inventor, and published on Mar. 13, 2008 may be modified to form channels about a central filter plug. Using a modified process of US 2008/060746, paper plies may be immersed in an adhesive bath and then wound around a central filter plug in a continuous flow in a staggered fashion. The plies may be driven by a belt so that the tube moves circularly around the filter plug until the wrapped filter plug is cut to form a mouth end portion for insertion into a smoking article. In the process of US 2008/060746, gaps may be formed between spirally wound plies so that one or more spiral channels are formed around the filter plug. The channels may be formed between one or more layers of plies that may be adhered on top of each other. The height of the channel will depend on the number of layers and the thickness of the paper used. The width will depend on the offset of parallel ply layers forming the channel.

In the process of US 2008/060746, overlapping inner plies are formed around a mandrel, which for the purposes of this disclosure could be the central filter plug, to form an inner layer. The spiral channels are formed from two or more intermediate plies, and an outer ply layer is formed over the intermediate layer to form spiral conduits from the channels. The inner and outer plies are thicker than the intermediate plies. For purposes of the present disclosure one or both of the inner plies and the outer plies of US 2008/060746 may be omitted. For example, channels formed by thin plies may be disposed directly on the central filter plug without an inner layer. Alternatively or in addition, an outer layer of the spirally wound tube may be omitted, and a plug wrap, tipping paper, or the like may be disposed about the mouth end segment during subsequent manufacturing steps of the smoking article.

It will be understood that material other than paper, such as cellulose film or the like, may be employed in the modified process of US 2008/060746 to form a mouth end portion of a smoking article.

Of course any suitable other process may be employed to form channels about a central filter plug. In embodiments, channels are formed parallel to the longitudinal axis of the mouth segment or smoking article, which are generally the same once the smoking article is fully constructed. By way of example, plies or strips of material, such as paper, cellulose film, or the like, may be deposited on a central filter plug or a layer surrounding a central filter plug by laminating, hotfoil stamping, or the like. Preferably three or more strips are employed to generate three or more channels. The strips may be layered on top of each other to achieve a desired channel height. The width of the channels will depend on the distance between adjacent strips. In embodiments, the channels are all of roughly equal width and are roughly equally spaced apart around the circumference of the central filter plug. As with spiral channels formed as described above, an exterior wrap will ultimately be placed about the linear channels to form a conduit through which smoke may flow.

Regardless of whether the channels are spiral, parallel to the longitudinal axis of the smoking article or otherwise, the channels are preferably sufficiently large to produce a low resistance to draw when the mouth end segment is incorporated into a smoking article. In embodiments, the channels have a cross sectional area of about 1.0 $mm^2$ or greater, such as about 4.0 $mm^2$ or greater or about 8.0 $mm^2$ or greater. Preferably, the channels have a cross sectional area of about 10.0 $mm^2$ or less, such as about 6.0 $mm^2$ or less or about 2.0 $mm^2$ or less. If the cross sectional area is too large, the structural integrity of the smoking article at the mouth end portion may be compromised. In embodiments, the height of the channels is from about 0.1 to about 1.0 mm, such as from about 1.5 mm to about 2.0 mm. In embodiments, the width of the channels is from about 1.5 to about 3.0 mm, such as from about 4.0 mm to about 6.0 mm.

In embodiments, the mouth end filter portion extends to the mouth end of the smoking article. In embodiments, the smoking article includes a tube disposed downstream of the mouth end filter portion, where the tube extends to the mouth end of the smoking article. The tube defines a central lumen and may include peripheral channels configured to be in communication with the peripheral region of the mouth end filter portion. That is, the peripheral channels of the tube may be positioned relative to the mouth end filter portion such that most or all of the smoke that flows through the peripheral region of the mouth end filter portion flows through the peripheral channels of the tube rather than through the central lumen of the tube. By way of example, channels in the peripheral region of the mouth end filter portion may be aligned with peripheral channels of the tube. The channel or channels of the tube may be spiral, linear, or any other suitable shape and may be of any suitable size. In embodiments, the channels of the tube are the same or similar shape as channels in the peripheral region of the mouth end filter segment. In embodiments, the channels of the tube have the same or similar width, depth or cross sectional area as channels in the peripheral region of the mouth end filter segment. The central lumen of the tube is preferably substantially axially aligned with the central filter plug of the mouth end filter portion. The central lumen of the tube may have a cross sectional area and shape the same or similar to the cross sectional area and shape of the central filter plug of the mouth end filter portion. The tube may be formed of any suitable material, such as a polymeric material, and may be of any suitable dimensions. In embodiments, the tube is between about 5 mm long and about 10 mm long. The outer diametric dimension of the tube is preferably the same or similar to the outer diametric dimension of the mouth end filter portion. The tube may be formed by a portion of the smoking article extending in the mouth direction beyond the mouth end of the mouth end filter portion, or it may be formed by a discrete tubular member.

The smoking article includes an exterior wrap disposed about the mouth end filter portion. The wrap may also be disposed about the mouth end tube, if included. The stiffness of the exterior wrap disposed about the peripheral region of the mouth end portion having the channels may vary depending on the height and width of the channels and on whether the channels are spirally wound, straight, etc. For example, a stiffer wrap may be desired with wider and higher channels; a stiffer wrap may be desired with linear channels relative to spiral channels of the same width and height; and the like.

In embodiments, the exterior wrap surrounding the channels is transparent or semi-transparent, such as transparent or semi-transparent cellulose film, allowing visualization of smoke flowing through the channels during use. If the smoking article also includes tipping paper disposed about the wrap, the tipping paper may also be transparent or semi-transparent so that the smoking in the mouth end filter segment channels, and the mouth end tube channels, if present, may be observed. In embodiments, where the mouth end filter portion or mouth end tube, if present, has spiral channels, swirling smoke may be observed through the transparent or semi-transparent wrap, providing visual interest.

A smoking article described in this disclosure may include a ventilation zone. The ventilation zone has an increased porosity that allows a greater amount of airflow into the device along the ventilation zone as compared to areas adjacent to the ventilation zone. The ventilation zone, which is typically in the form of perforations in the wrapper, may be upstream of the mouth end portion or in the region of the mouth end portion. Regardless of the location of the ventilation zone, the ventilation zone preferably provides between about 30% and about 90% dilution of the mainstream smoke, more preferably between about 50% and about 80% dilution of the mainstream smoke. "Dilution" refers to the percentage by volume of air that is included in the smoke delivered to the consumer from the mouth end of smoking article with the ventilation zone completely open. The level of ventilation or dilution achieved by the ventilation zone can be determined using ISO test method 9512: 2002.

While the smoking articles described herein have a novel and inventive mouth end portion, they preferably maintain one or more attributes that may be desirable to consumers, such as overall length or appearance, firmness or feel, overall resistance to draw, full mouth effect, and the like. Mouth fullness is a perception of richness and volume in the mouth and throat of the smoke unrelated to other sensations like, for example, coating, dryness or astringency. Full mouth effect or mouth fullness is expected to result either from spiral channels that should produce a swirling effect or linear channels.

The mouth end portions described herein may be included in any suitable smoking article, such as combustible smoking articles including cigarettes, cigars, cigarillos, and the like or non-combustible aerosol generating smoking articles.

Smoking articles that incorporate a mouth end portion may also include an upstream filter portion and a tobacco rod. The tobacco rod of combustible smoking articles is typically formed from shredded tobacco leaves. A plug wrap may circumscribe the mouth end portion or the mouth end portion and the filter portion. Thus, the plug wrap may, in embodiments, circumscribe the exterior wrap surrounding the channels of the mouth end filter portion or may circumscribe at least a portion of the exterior wrap. Tipping paper will typically surround the entire filter portion and an adjacent portion of the tobacco rod.

Smoking articles that include aerosol-generating devices typically comprise an aerosol-forming substrate that is assembled, often with other components, in the form of a rod. Often, such a rod is configured in shape and size to be inserted into an aerosol-generating device that comprises a heating element for heating the aerosol-forming substrate. "Aerosol-forming substrate" as used herein is a type of smoking composition that can be used in an aerosol-generating device to produce an aerosol. The aerosol-forming substrate can be in solid form or liquid form. The substrate can comprise both liquid and solid components. The aerosol-forming substrate may comprise tobacco. Optionally, the aerosol-forming substrate may be provided on or embedded in a carrier which may take the form of powder, granules, pellets, shreds, spaghetti-like strands, strips or sheets. The aerosol-forming substrate may be deposited on the surface of the carrier in the form of, for example, a sheet, foam, gel or slurry. The aerosol-forming substrate may be deposited on the entire surface of the carrier, or alternatively, may be deposited in a pattern in order to provide a non-uniform flavor delivery during use. Non-combustible aerosol generating smoking articles may include a mouth end portion as described herein and may include an upstream filter portion.

Referring now to FIGS. 1-5, schematic drawings are depicted that illustrate various aspects of novel smoking articles or mouth end portions thereof. The drawings are not necessarily to scale and are presented for purposes of illustration and not limitation. The drawings depict various aspects described herein. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labelled with the same number. In addition, the use of different numbers to refer to components is not intended to indicate that the different numbered components cannot be the same or similar.

The schematic drawings presented herein are not necessarily to scale, but are shown merely for purposes of illustration.

Figure 1:
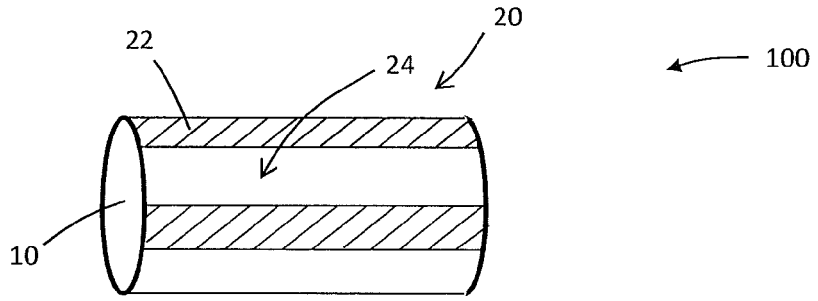
FIG. 1 is a schematic perspective view of an embodiment of a mouth end portion of a smoking article.

Referring now to FIG. 1, a mouth end filter portion 100 of a smoking article is depicted. The depicted mouth end filter portion 100 includes a central filter plug 10 and a peripheral region 20 disposed about the central filter plug 10. The peripheral region includes strips 22 that form channels 24 between the strips 22, which can be better seen in the end view depicted in FIG. 2. The channels 24 depicted in the mouth end filter portion of FIG. 1 run parallel to each other and to the longitudinal axis of mouth end portion. When incorporated into a smoking article, the channels may extend to the mouth end of the article. While not shown, it will be understood that an intermediate layer may be present between the central filter plug 10 and the strips 22 forming the channels 24. It will also be understood that an outer layer disposed about the strips 22 forming the channels 24 may be included in the mouth end filter portion 100 before the mouth end filter portion is included in a smoking article.

Figure 3:
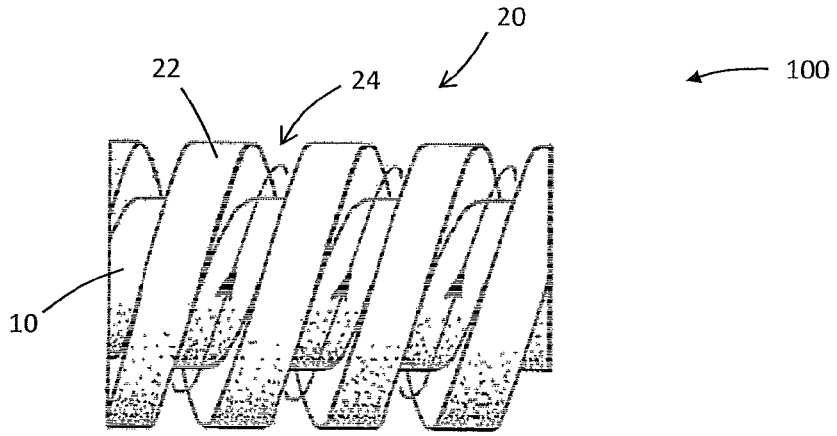
FIG. 3 is a schematic perspective view of an embodiment of a mouth end portion of a smoking article.

FIG. 3 depicts an alternative embodiment of a mouth end filter portion 100 of a smoking article, in which the channel 24 formed by strip 22 is spirally would around the central filter plug 10. As with the mouth end filter portion 10 depicted in FIG. 1, the channels 24 of the mouth end filter portion 100 depicted in FIG. 3 may extend to the mouth end of a smoking article, when incorporated into the smoking article.

Figure 2:
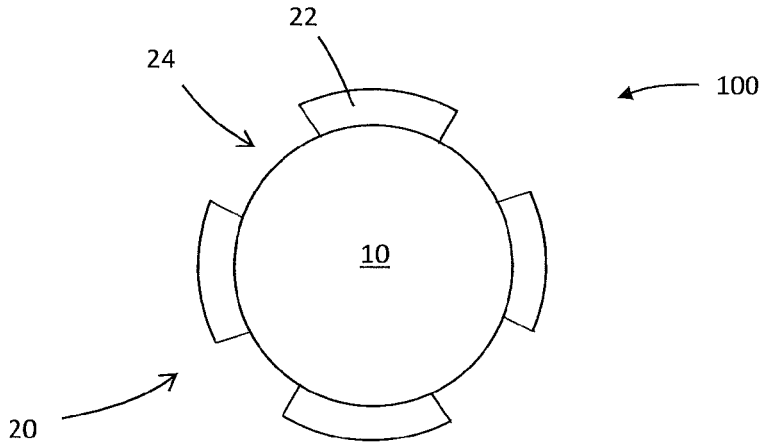
FIG. 2 is a schematic end view of an embodiment of the mouth end portion depicted in FIG. 1.
Figure 4:
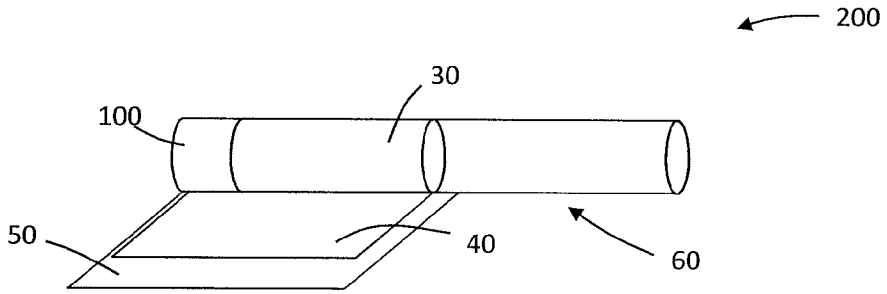
FIG. 4 is a schematic longitudinal section of an embodiment of a smoking article.

FIG. 4 depicts a smoking article 200 into which a mouth end filter portion 100, such as a mouth end filter portion depicted in FIG. 1, FIG. 2 or FIG. 3, is incorporated. The mouth end filter portion 100 is incorporated into the smoking article 200 such that the channels (not shown in FIG. 4) extend to the mouth end of the article. The depicted smoking article 200 further includes a filter portion 30 upstream of the mouth end portion 100. While the mouth end filter portion 100 is shown in FIG. 4 as abutting the upstream filter portion 30, it will be understood that the mouth end portion 100 and upstream filter 30 may be placed adjacent one another with a space or gap (not shown) between the mouth end filter portion 100 and the upstream filter 30. The depicted smoking article 200 includes a tobacco rod 60 upstream of the filter 30. The smoking article 200 optionally includes a plug wrap 40 that circumscribes at least a portion of the mouth end portion 100 and may circumscribe at least a portion of the filter 30, as depicted. The plug wrap 40 may be a stiff plug wrap which may enhance firmness of the smoking article at the mouth end portion by providing stiffness over the cavities (not shown in FIG. 4) of the mouth end portion 100. Tipping paper 50 or other suitable wrapper circumscribes the mouth end portion 100 and filter portion 30 and may overlap the tobacco rod 60 as is generally known in the art.

Figure 5:
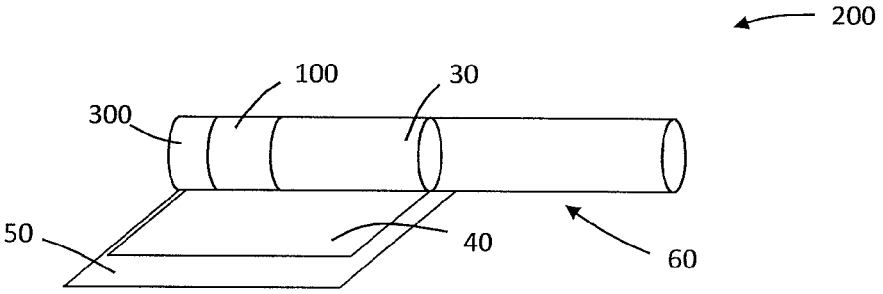
FIG. 5 is a schematic longitudinal section of an embodiment of a smoking article.
Figure 6:
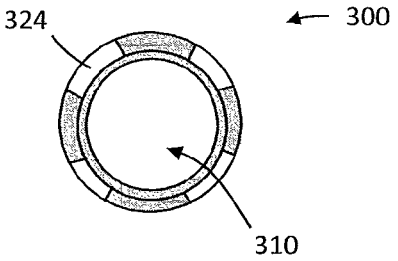
FIG. 6 is a schematic end view of an embodiment of a tubular element depicted in FIG. 5.

FIG. 5 depicts a smoking article 200 into which a tube 300 is disposed within the mouth end of the smoking article, and FIG. 6 depicts an end view of the tube 300. The tube 300 is downstream of, and abuts, the mouth end filter portion 100, which may be a mouth end filter portion 100 depicted in FIG. 1, FIG. 2, or FIG. 3. The tube 300 defines a central lumen 310 that aligns with the central plug (10; see, for example, FIG. 2) of the mouth end filter portion 100. The tube 300 includes peripheral channels 324 that align with the peripheral channels (24; see, for example, FIG. 2) of the mouth end filter portion 100. The smoking article 200 depicted in FIG. 5 further includes a filter portion 30 upstream of the mouth end portion 100. While the mouth end filter portion 100 is shown in FIG. 5 as abutting the upstream filter portion 30, it will be understood that the mouth end portion 100 and upstream filter 30 may be placed adjacent one another with a space or gap (not shown) between the mouth end filter portion 100 and the upstream filter 300. The depicted smoking article 200 includes a tobacco rod 60 upstream of the filter 30. The smoking article 200 optionally includes a plug wrap 40 that circumscribes at least a portion of the mouth end portion 100 and may circumscribe at least a portion of the filter 30, as depicted. The plug wrap 40 may be a stiff plug wrap which may enhance firmness of the smoking article at the mouth end portion by providing stiffness over the cavities (not shown in FIG. 5) of the mouth end portion 100. Tipping paper 50 or other suitable wrapper circumscribes the mouth end portion 100 and filter portion 30 and may overlap the tobacco rod 12 as is generally known in the art.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The invention claimed is:

1. A smoking article comprising a filter consisting essentially of:

a mouth end filter portion including a central filter plug having an outer surface and a peripheral region disposed about the outer surface of the central filter plug;

an exterior wrap disposed about the peripheral region of the mouth end filter portion, wherein the permeability of smoke through the peripheral region is five times or more greater than the permeability of smoke through the central filter plug;

wherein the peripheral region comprises one or more channels through which smoke is configured to flow, wherein the one or more channels are formed from one or more strips disposed about and in contact with the central filter plug, and further wherein the one or more channels extend from the outer surface of the central filter plug to an inner surface of the exterior wrap; and an upstream filter portion upstream of the mouth end filter portion, wherein the upstream filter portion is substantially the same diameter as the mouth end filter portion, and wherein the upstream filter portion contributes substantially more to filtering than the mouth end portion, and wherein the upstream filter portion is free of peripheral channels, wherein the mouth end filter portion abuts the upstream filter portion.

2. A smoking article according to claim 1, wherein the permeability of smoke through the peripheral region is ten or more greater than the permeability of smoke through the central filter portion.

3. A smoking article according to claim 2, further comprising tipping paper circumscribing at least a portion of the exterior wrap.

4. A smoking article according to claim 2, wherein the one or more channels have a cross-sectional area of about 1.0 $mm^2$ or greater along the length of the channels.

5. A smoking article according to claim 2, wherein the central filter portion comprises cellulose acetate tow.

6. A smoking article according to claim 5, wherein the central filter portion further comprises at least 10 % by weight of a plasticizer.

7. A smoking article according to claim 2, further comprising an upstream filter portion adjacent and upstream of the mouth end portion.

8. A smoking article according to claim 7, wherein the upstream filter portion has permeability different than the permeability of the central filter plug.

9. A smoking article according to claim 7, wherein the upstream filter portion has a diameter substantially the same as the diameter of the mouth end portion.

10. A smoking article according to claim 1, further comprising tipping paper circumscribing at least a portion of the exterior wrap.

11. A smoking article according to claim 1, wherein the one or more channels have a cross-sectional area of about 1.0 $mm^2$ or greater along the length of the channels.

12. A smoking article according to claim 1, wherein the one or more channels have a width of about 1.0 mm or greater along the length of the channel and have a height of about 0.1 mm or greater along the length of the channel.

13. A smoking article according to claim 1, wherein the central filter portion comprises cellulose acetate tow.

14. A smoking article according to claim 13, wherein the central filter portion further comprises at least 10 % by weight of a plasticizer.

15. A smoking article according to claim 1, wherein the exterior wrap comprises one or more ventilation holes upstream of the mouth end filter portion.

16. A smoking article according to claim 1, wherein the mouth end filter portion extends to a mouth end of the smoking article.

17. A smoking article according to claim 1, further comprising a tube comprising peripheral channel and defining an inner lumen, wherein the inner lumen is substantially axially aligned with the central filter plug of the mouth end filter portion and wherein the peripheral channel of the tube is configured to communicate with the peripheral region of the mouth end filter portion.

18. A smoking article according to claim 1, wherein the filter has a resistance to draw of about 50 mm water gauge (WG) to about 500 mm WG.

19. A smoking article according to claim 1, wherein no visible staining of the mouth end central filter plug is observable after the smoking article is smoked.

20. A smoking article according to claim 1, wherein the upstream filter portion has permeability different than the permeability of the central filter plug.

21. A smoking article comprising a filter consisting essentially of:

a mouth end filter portion including a central filter plug having an outer surface and a peripheral region disposed about the outer surface of the central filter plug;

an exterior wrap disposed about the peripheral region of the mouth end filter portion, wherein the permeability of smoke through the peripheral region is five times or more greater than the permeability of smoke through the central filter plug;

wherein the peripheral region comprises one or more channels through which smoke is configured to flow, wherein the one or more channels are formed from one or more strips disposed about and in contact with the central filter plug, and further wherein the one or more channels extend from the outer surface of the central filter plug to an inner surface of the exterior wrap; and an upstream filter portion upstream of the mouth end filter portion, wherein the upstream filter portion is substantially the same diameter as the mouth end filter portion, and wherein the upstream filter portion contributes substantially more to filtering than the mouth end portion, and wherein no visible staining of the mouth end central filter plug is observable after the smoking article is smoked, wherein the mouth end filter portion abuts the upstream filter portion.

* * * * *